United States Patent [19]

Halstead

[11] Patent Number: 4,459,717

[45] Date of Patent: Jul. 17, 1984

[54] TOOL FOR CABLE TIE INSTALLATION AND REMOVAL

[75] Inventor: William M. Halstead, Baltimore, Md.

[73] Assignee: Henry Mann Incorporated, Huntingdon Valley, Pa.

[21] Appl. No.: 532,354

[22] Filed: Sep. 15, 1983

[51] Int. Cl.[3] ..... B25F 1/00; B26B 13/22

[52] U.S. Cl. ..... 7/134; 7/158; 30/250

[58] Field of Search ..... 7/158, 125, 132, 134; 81/3 R; 30/244, 253, 254, 249, 250; 29/235, 270, 278

[56] References Cited

U.S. PATENT DOCUMENTS

| | | | |
|---|---|---|---|
| 264,696 | 9/1982 | Hillard | 7/158 |
| 2,389,648 | 11/1945 | Stafford | 30/151 |
| 2,711,109 | 6/1955 | Gillstrom | 81/3 R |
| 2,808,647 | 10/1957 | Ikeuchi | 30/253 |
| 3,154,114 | 10/1964 | Bailey | 140/106 |
| 3,168,119 | 2/1965 | Schwester et al. | 140/123.6 |
| 4,335,477 | 6/1982 | Halstead | 7/158 |

FOREIGN PATENT DOCUMENTS

| | | | |
|---|---|---|---|
| 44288 | 10/1910 | Austria | 30/244 |
| 28992 | of 1911 | United Kingdom | 30/253 |

*Primary Examiner*—Roscoe V. Parker

*Attorney, Agent, or Firm*—Munson H. Lane, Jr.

[57] ABSTRACT

A compound tool for installation of a cable tie band. The elongated tool has a transversely disposed open-ended, rectangular slot that broadly approximates the tie band in cross-section and through which the free end of a loosely assembled tie band is threaded, firmly tensioned and finger clamped on the tool handle, the tool bottom being fulcrumed on the band at the tie head. The tool is then rotated to tighten the band and secure the bundle. A cutter blade, incorporated in the tool structure, is so pivotally mounted and configured that in the shearing of the excess of tie band, the blade initiates shearing at the outside edge of the band-slot assembly and continuously during shearing exerts only a clamping force which influences the tie band into the slot.

4 Claims, 7 Drawing Figures

TOOL FOR CABLE TIE INSTALLATION AND REMOVAL

BACKGROUND OF THE INVENTION

This invention relates to a unitary device for cable tie installation and cable tie removal.

In the banding of tying of a bundle of cables, or the like elongated elements, it is known to use a tool for gripping the free end of a loosely assembled tie and to manipulate the tool to thereby tighten and lock the tie about the bundle and to thereafter manipulate a cutter means, which is incorporated into the tool structure, for the removal of the excess length of the tie band.

Conventional tools, whether for installation or for removal of a tie band, generally operate in scissor fashion; i.e. the cutting blades initially contact the workpiece at the apex of the crossing blades and exert forces which influence the workpiece in an ejection direction towards the open end of the cutting blades and maintain such an ejection tending force throughout the cutting operation. The component of expended forces which tend to eject the workpiece are wasted and interfere with an efficient cutting operation when the workpiece is especially hard and tough.

SUMMARY OF THE INVENTION

The invention is directed to a tool of unitary structure which is both a cable tie band installation device and a cable tie removal device. The installation portion of the tool comprises an elongated handle member having a transversely disposed open-ended, rectangular slot at a bottom portion of a relatively thin plate therewith whereby to receive the free end of a relatively loosely assembled tie band and to thereafter manipulate the slotted handle member for tensioning or tightening the tie and a pivotal cutter blade mounted on said elongated member for removal of the excess length of tie band. The pivot point of the blade is so located and the blade so configured, that perforce it initiates contact with, and shearing of, the tie band at an outer edge whereby, throughout the shear stroke, the tie band is clamped and urged into the slot. The tool has a tapered jaw member forming the bottom element of the slot defining structure. The tapered jaw is adapted for insertion between the tie and cable whereupon the cutter blade may be actuated for shearing the band.

It is an object of the invention to provide a compound tool as described that is of simple structure, is inexpensive to manufacture and easy to use.

BRIEF DESCRIPTION OF THE DRAWINGS

The invention will be more readily understood by reference to the accompanying drawings and the following detailed description in which specific embodiments of the invention are set forth by way of illustration and not by way of limitation, it being understood that numerous additional modifications and variations may be resorted to without departing from the spirit of the invention in its broadest aspects as will be apparent to those skilled in the art.

In the drawings.

DESCRIPTION OF THE INVENTION

Figure 1:
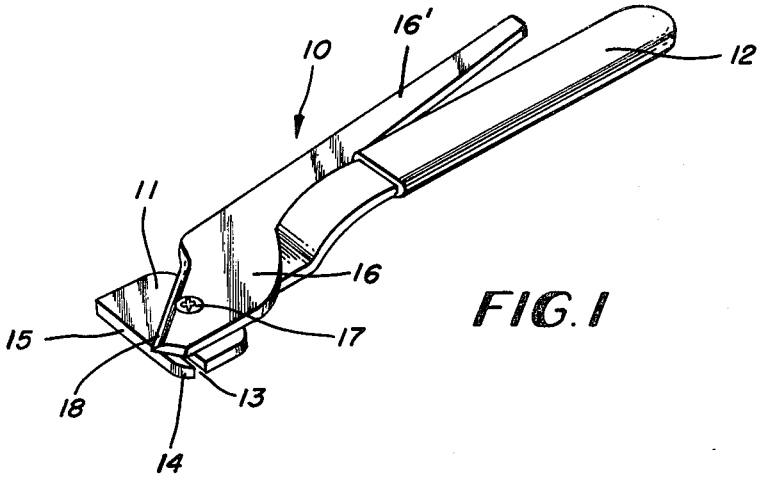
FIG. 1 is a perspective view of the tool.
Figure 2:
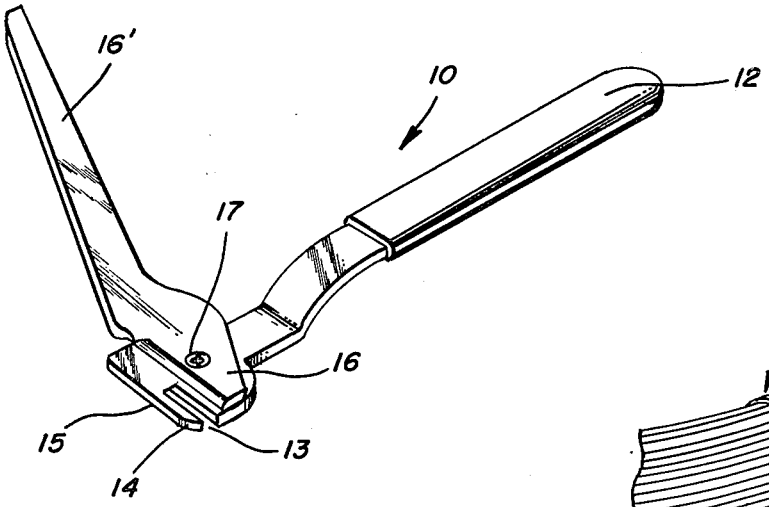
FIG. 2 is a perspective view of the tool in open position, the slot fully exposed.
Figure 3:
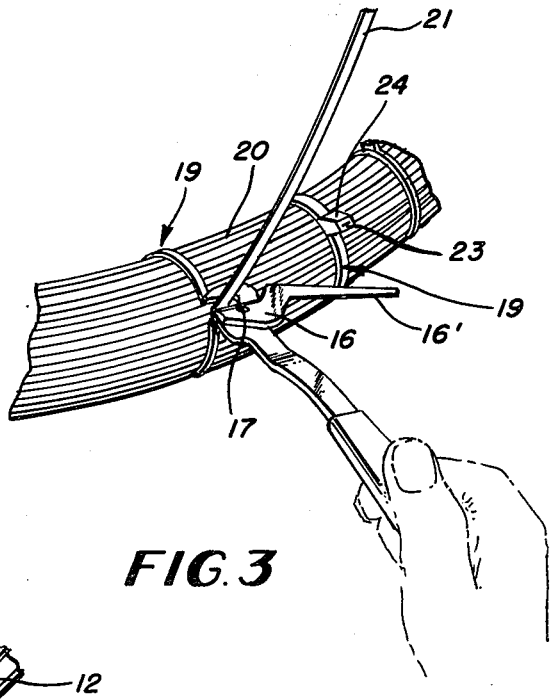
FIG. 3 is a perspective view of the tool in receipt of the free length of the relatively loosely assembled tie.
Figure 4:
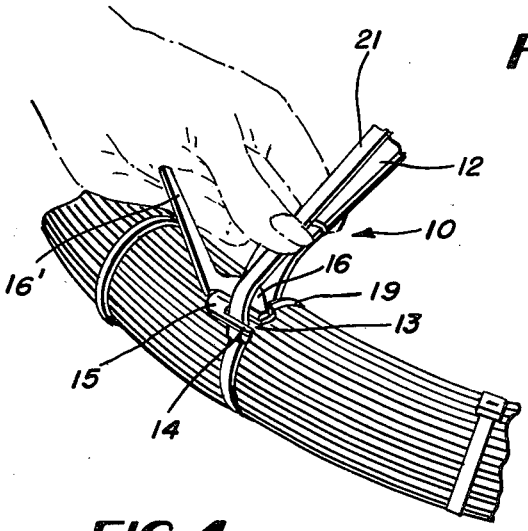
FIG. 4 is a perspective view as in FIG. 3 but showing the free length of the tie being grasped by the operator preparatory to tightening.
Figure 5:
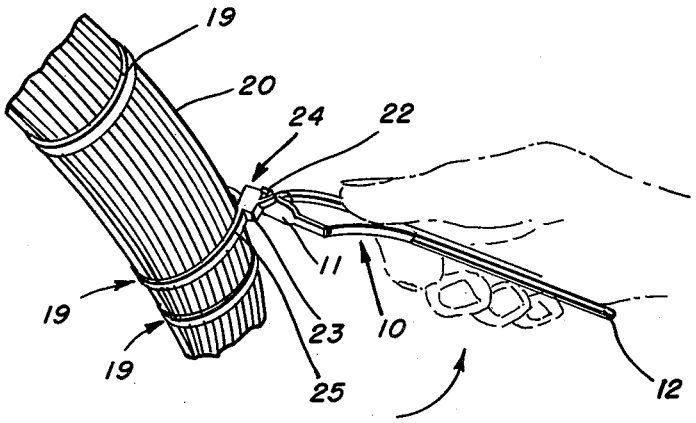
FIG. 5 is a perspective view as in FIG. 4 but showing the tool jaw supported on the tie head and rotation of the tool and tie length therewith for effecting tightening and locking of the tie to secure the bundle.
Figure 6:
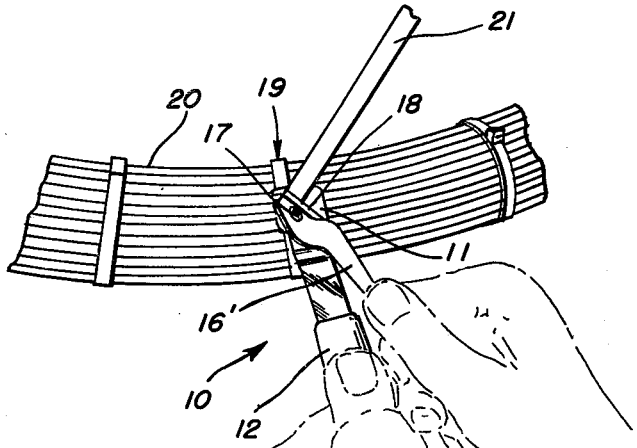
FIG. 6 is a perspective view as in FIG. 5 but after securement of the bundle and in the process of rotating the cutter blade to sever the excess length of tie band.

Referring to FIGS. 1 and 2, a cable tie installation and tie removal device 10 is disclosed comprising a relatively thin plate 11 attached to an elongated handle 12 which is preferably offset and parallel thereto; a relatively narrow transversely extending open-ended, rectangular slot 13 disposed at near the bottom or free end of said plate; a tapered end 14 on the jaw member 15, the tapered end forming the bottom element of the end opening of the slot defining plate structure; and a cutter blade 16 overlying and pivotally mounted by pivot 17 on plate 11 and having a handle 16' extending scissor fashion with respect to handle 12 and having a cutting edge 18 adapted to associate with the face of the slot defining structure to form a cutting couple when the cutter blade is rotated for shearing. The cutter blade preferrably is mounted at a pivot point located above and in a general vertical alignment with the back wall of the slot. In open position, the blade's cutting edge preferrably lies generally parallel to the slot. Thus, during shearing, the blade perforce makes initial contact with the upper, outer edge of tie band and throughout the shearing stroke exerts a force which clamps and urges the tie band against the slot end wall; the blade at the completion of its stroke reaching at least the line of the back wall to thereby completely sever the tie band.

Obviously, the aforesaid pivot point may be otherwise located, as for instance transversely displaced from the slot, and the blade's cutting edge otherwise configured in order to effect the above described shear stroke which initiates at the outer limit of the tie band-slot assembly and then proceeds generally transversely across the slot while continuously clamping and urging the tie band into the slot against the end wall thereof.

FIGS. 3 through 6 illustrate use of the device as a tie installation means. A one-piece, self-locking tie 19 is relatively loosely assembled to a cable, or the like bundle, and the tool is placed so that the free length 21 of the tie extends through the slot. The jaw member 15 is supported on the far side 22 of the exit face 23 of the self-locking tie head 24, and the tool extends generally normal to such tie head face or at an angle thereto in the direction towards the tie band portion 25 integral with the head. The operator then grasp and draws the free length of the tie, which in relatively loose assembly has been drawn firmly through the tie head, to a tensioned, finger clamped position on the tool handle. Then using the tie head as a fulcrum, the tool and finger clamped tie portion thereon are rotated about said jaw member towards the bundle and away from the tie band portion integral with said head to thereby further tension and draw the tie band through the tie head and to secure said bundles.

It is obvious that a quick release clamp means could be substituted for the operator's finger clamping manipulation but such modification would not be cost effective in either of time or manufacture and in a practical sense would not effect a more secured bundle.

Having now secured the bundle, and with the tool still in place, and in effect in one continuing motion, the operator rotates the cutter blade to sever the excess free length of tie band.

Figure 7:
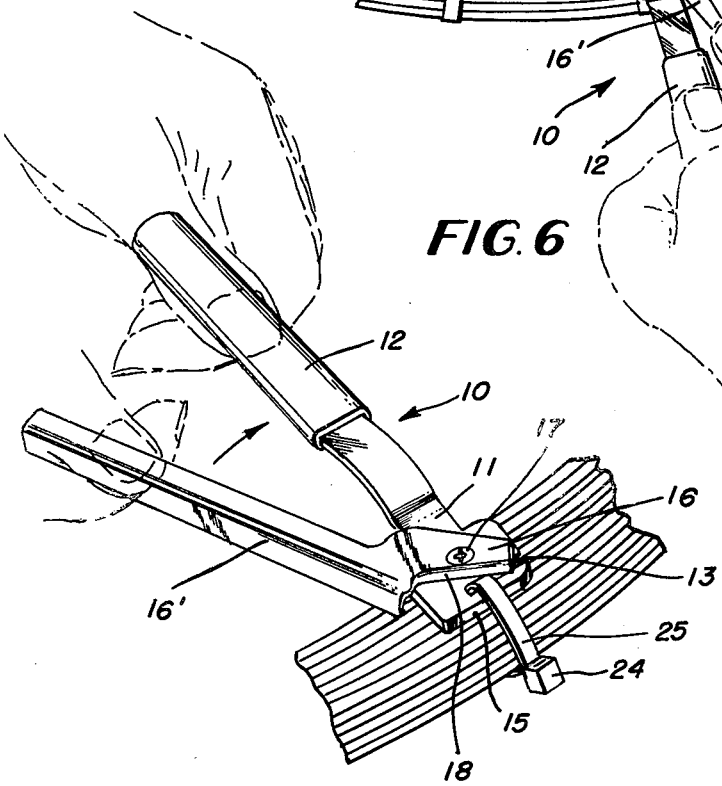
FIG. 7 is a perspective view of the tool being utilized for tie removal.

FIG. 7 illustrates use of the device as a tie removal tool. The tapered end of the jaw member is forced through a section between the tie and bundle so that a transverse section of the tie lies fully within the slot. The cutter blade 18 is then rotated to shear the tie to release the bundle.

Thus, the innovative tool defined materially differs from conventional scissor-type tools by producing an inwardly directed cutting stroke which eliminates the component of force that tends to eject a workpiece and results in a more efficient expenditure of energy and time.

Preferred embodiments of the invention have been described in detail for the purpose of illustration but it will be obvious that numerous modifications and variations may be resorted to without departing from the spirit of the invention in its broadest aspects.

What is claimed is:

1. A hand tool, for installation of a self-locking tie band about a cable or bundle of electrical conductors or the like, having means whereby to tension the tie band for securing the bundle and to remove the excess of the band comprising:

a relatively thin rigid plate having an elongated handle extending therefrom;

the plate including a relatively narrow, transversely extending, open-ended rectangular slot disposed at the bottom of the free end section opposed to the handle;

the slot being adapted to receive therethrough the free length of the tie band loosely assembled to the cable;

the tool being adapted to be supported on its bottom element of the slot defining structure and against the self-locking head of the loosely assembled tie band;

whereby with the tool so supported and with said free tie band length drawn through the slot and tensioned and using the supported bottom as a fulcrum, the tool is further adapted to be rotated whereby to draw the tie band through the self-locking head until the cable or bundle is secured;

a blade overlying and pivotally mounted on said plate and having a cutting edge operatively associated with the face of the slot defining structure so as to form a cutting couple therewith;

a handle extending from the blade in operative association with the first recited handle; and the pivot point of the blade being so located and the cutting edge thereof being so contoured that the blade during its shearing stroke perforce initially engages the tie band at an outer edge and proceeds transversely across the slot whereby to continuously exert a clamping force which urges the tie band into, and against the back wall of, the slot.

2. A hand tool as in claim 1 wherein the pivot point of the blade is located above and in generally vertical alignment with the back wall of the slot, and in open position the blade's cutting edge lies generally parallel with the slot whereby during shearing the blade effects said initial contact and clamping of, and urging on, the tie band.

3. A hand tool as in claim 1 wherein said bottom element of the slot defining structure is tapered at its free end whereby to facilitate entry of the element under the inner face of a band of a secured cable or bundle for receiving such band in the slot and for thereafter utilizing the cutting couple to free the band from said cable or bundle.

4. A hand tool as in claim 2 wherein said bottom element of a slot defining structure is tapered at its free end whereby to facilitate entry of the element under the inner face of a band of a secured cable or bundle for receiving such band in the slot and for thereafter utilizing the cutting couple to free the band from said cable or bundle.

* * * * *